United States Patent [19]

Barnett

[11] 4,124,925

[45] Nov. 14, 1978

[54] EXPANDED METAL

[75] Inventor: Frank Barnett, Hartlepool, England

[73] Assignee: The Expanded Metal Company Limited, England

[21] Appl. No.: 693,533

[22] Filed: Jun. 7, 1976

[30] Foreign Application Priority Data

Jun. 5, 1975 [GB] United Kingdom ..... 24277/75

[51] Int. Cl.[2] ..... B26D 1/08; B26D 3/08; B21D 28/14; B21D 31/04

[52] U.S. Cl. ..... 29/6.2; 29/163.5 R; 72/326; 72/332; 83/695

[58] Field of Search ..... 29/6.1, 6.2, 163.5 R; 72/326, 332, 331; 83/620, 695; 30/355

[56] References Cited

U.S. PATENT DOCUMENTS

| | | | |
|---|---|---|---|
| 460,677 | 10/1891 | Christy | 30/355 |
| 604,695 | 5/1898 | Fordyce | 29/6.1 |
| 2,828,792 | 4/1958 | Hill | 29/6.2 X |
| 3,161,943 | 12/1964 | Maier | 29/6.2 |
| 3,162,925 | 12/1964 | Felsenthal | 29/163.5 R X |
| 3,570,086 | 3/1971 | Stone | 83/695 X |
| 3,840,952 | 10/1974 | North | 29/6.2 |

*Primary Examiner*—Othell M. Simpson
*Assistant Examiner*—Horace M. Culver
*Attorney, Agent, or Firm*—Robert E. Burns; Emmanuel J. Lobato; Bruce L. Adams

[57] ABSTRACT

A reciprocating knife expanded metal machine has a knife for producing parallel strand expanded metal mesh. The knife has cutting teeth with the effective cutting edges of adjacent teeth spaced by a distance almost as great as the length of an effective cutting edge of a tooth. The leading portion of the cutting edge of each tooth is longitudinally and convexly curved.

4 Claims, 3 Drawing Figures

EXPANDED METAL

The invention relates to the production of so-called parallel strand expanded metal mesh. Such mesh is produced on a reciprocating knife machine of which the effective cutting edges of adjacent knife teeth have a seperation almost as great as the length of an effective cutting edge of a tooth. Between each cutting stroke the knife moves to or fro in a direction parallel to the length of the knife, that is transvesely to the direction of feed of the metal past the knife, through a distance equal to half the pitch between adjacent teeth. Conventionally, each knife tooth has a straight leading edge over substantially its full width and is only cut back at the ends of the tooth. This tooth formation, together with a short cutting stroke of the knife, results in a mesh of distinctive shape. This distinctive shape has longitudinal rows of transversely elongate apertures and a row of continuous zig-zag knuckles separating each adjacent pair of longitudinal rows of apertures. The strands defining the longer sides of each aperture, and hence separating the apertures in each longitudinal row of apertures, are parallel to one another. These strands have a width which is of the same order of magnitude as the short width of the elongate apertures. In fact the metal is very little expanded overall, the apertures being formed by the cutting and twisting of the parallel strands as much by the expansion which is produced by the short arms of the knuckles produced by the cut back edges of the knife teeth.

The knuckle arms correspond to the "strands" in a conventional mesh and the strands correspond to the "joints" in a conventional mesh.

This form of expanded metal mesh has a number of uses, for example in ornamental grills. It has recently been appreciated, however, that the form of the mesh makes it particularly useful as an electrode material since a large surface area of the metal is exposed without excessive expansion of the metal. In particular it has been proposed to form titanium electrodes from a parallel strand expanded titanium mesh. Now whereas parallel strand mesh has been produced from thin gauge aluminium and steel sheet, in which case little difficulty has been encountered in expanding the thin materials, a considerably greater working reaction is required to force the full width of the flat leading edges of the knife teeth simultaneously through a sheet of titanium metal having a thickness of up to 0.1 inch or more. If a conventional reciprocating knife machine is used, the impact reaction when the teeth impact the titanium sheet produces appreciable play in the knife bearings and results in poor control of the depth with which the knife teeth penetrate the metal and hence in the resulting aperture size.

In accordance with the present invention, it has been found that this problem can be solved and the cutting reaction appreciably reduced if the leading portion of the cutting edge of each knife tooth is longitudinally and convexly curved. In use during each cutting stroke. The metal will first be contacted and sheared by the center of each tooth and as the tooth penetration increases, a strand will be produced by a progressive shearing in both directions from the center to each end of the tooth.

Owing to the convex shape of the leading central portion of the cutting edge of each tooth, the strands forming the longer sides of the transversely elongate apertures in the mesh will be similarly curved. However, the strands dividing the apertures in each row will be parallel to one another and for many purposes, including use as an electrode material, this is satisfactory as straight parallel strand mesh. The curvature need only be slight, for example an amount which displaces the center of a parallel strand, by no more than half of the width of the strand, perpendicularly to the line joining the ends of that strand.

When the mesh is to be used as an electrode material, it is desirable that the ends of the apertures should be as open as possible to avoid gas bubble retention. It is therefore desirable for the limbs of the knuckles at the ends of the apertures to be an appreciable angle, say at least 70° to one another. For this purpose it is desirable if the end portions of the cutting edge of each knife tooth are inclined sharply backwards so that these end portions penetrate the metal and positively form the corresponding knuckle limbs at an angle to the ends of the curved strands.

An example of the production of a curved parallel strand mesh utilizing a knife in accordance with the invention is illustrated in the accompanying drawings, in which.

Figure 1:
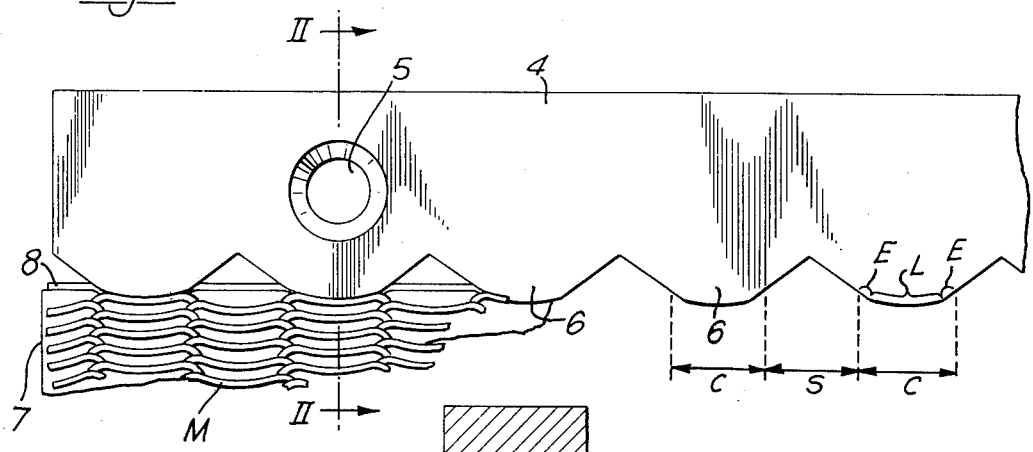
FIG. 1 is a partial front elevation showing the production of the mesh.
Figure 2:
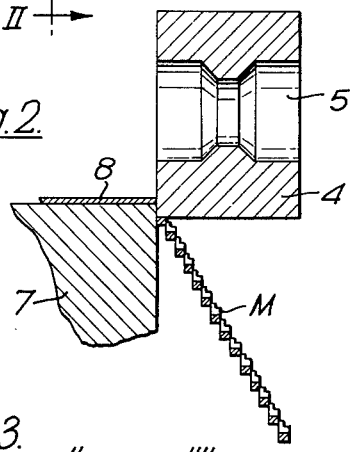
FIG. 2 is a section taken on the line II—II in FIG. 1.

As shown in FIGS. 1 and 2, a reciprocating knife 4, formed with clamping apertures 5 for receiving clamping bolts, and with teeth 6, cooperates with a fixed shearing block 7 over which sheet metal 8 is advanced in step-wise fashion. The knife 4 makes a downward working stroke, discontinuously shearing the sheet metal 8. The knife 4 then makes an upward idle stroke and is shifted longitudinally and horizontally by a distance equal to half the spacing of the centers of the teeth 6, while the sheet 8 is advanced one step over the block 7. The knife 4 then makes a further downward working stroke to shear discontinuously the sheet 8 whereafter it makes an upward idle stroke and is shifted longitudinally back again prior to making a working stroke and recommence the cycle.

The novel feature lies in the configuration of the teeth 6. As shown in FIG. 1, the effective cutting edge of each tooth 6, that is the part of the tooth which penetrates the sheet metal 8 during a working stroke, has an axial length as indicated by C. Adjacent effective cutting edges are spaced by an interteeth distance S which is almost as great as the length C. The distance S is preferably at least 90% of C. In this case S is 1.213 in. and C is 1.240 in. Each effective cutting edge C consists of a smoothly and slightly curved leading portion L extending over the majority of its length. The radius of curvature of L is preferably between one and two times the length of L. In this case L is 1.177 in. long and has a radius of curvature of 1.75 in. The ends of the effective cutting edge C, at each end of the leading portion L, are comparatively sharply cut back at an angle of at least 35° and in this case of substantially 35° to the length of the knife, to form straight end portions E. These portions continue beyond the ends of the effective cutting edges C until they meet one another to define the intersections of the teeth.

Figure 3:
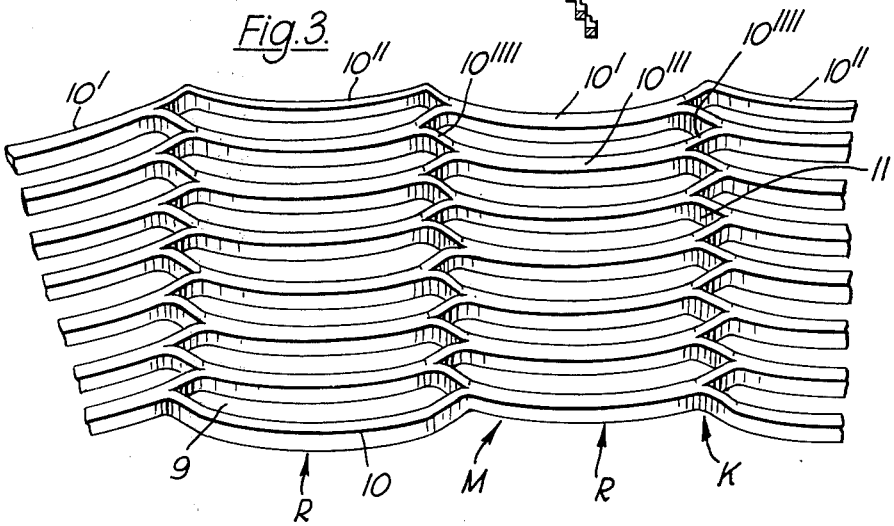
FIG. 3 is a plan of a portion of the mesh product.

These shapes and dimensions of the cutting teeth are critical in the production of the mesh M which is particularly shown in FIG. 3. Thus the mesh consists of a number of longitudinal rows R of transversely elongate apertures 9 separated by curved strands 10 which are generally parallel to one another, and the widths of which are comparable in size to the narrower dimensions of the apertures 9. Adjacent rows R are separated by continuous zig-zag rows K of knuckles. It will be appreciated that the apertures 9 in adjacent rows R are slightly longitudinally offset from one another as a result of being produced in alternate working strokes of the knife 4. Thus the strands 10' are simultaneously cut in one working stroke and the strands 10'' are simultaneously cut in the succeeding working stroke. The shape of each strand 10 corresponds generally to that of the effective cutting edge C of each tooth 6. Thus each strand 10 consists of a gently curving central portion 10''' which is inclined at a bigger angle to the transverse direction of the mesh. These edge portions, which are produced by the edge portions E of the tooth cutting edge, ensure that the angles 11 at the knuckles at the ends of each aperture 9 are comparatively wide, for example on the order of 70°. The slot length-to-strand length ratio in the illustrated example is approximately 100:95.

It will be appreciated that at the beginning of a working stroke of the knife 4, the very central point of the leading portion L of each tooth 6 comes into contact and shears the very central point of a corresponding strand 10. As penetration increases upon continuence of the working stroke, two points of shear between the leading portion L and the metal move progressively and symmetrically along each leading portion L away from the very central point. It follows that at any instance shearing is only taking place at two points. This continues during the final portion of the cutting stroke during penetration of the end portions E of the cutting edges.

The illustrated mesh is made from titanium and is particularly intended for use as an electrode. However, it may be made of other metals and the product may alternately have uses as a fine sieve, or as an ornamental grid. The mesh may be flattened after expansion if so required in the particular application.

I claim:

1. In an expanded metal machine of the type incorporating a reciprocatory knife for producing parallel strand expanded metal mesh, the improvement comprising: a reciprocatory knife having a longitudinal row of cutting teeth, each tooth having an effective cutting edge defined by a longitudinally and convexly curved leading central portion terminating at both ends thereof in straight end portions each inclined sharply backwardly with respect to the axial length of the knife, and each tooth being spaced from an adjacent tooth such that the effective cutting edges of adjacent teeth are spaced apart an axial distance almost as great as the axial length of said effective cutting edge of a said tooth.

2. An expanded metal machine according to claim 1; wherein the interteeth spacing between the effective cutting edges of adjacent teeth has an axial length at least 90% of the axial length of said effective cutting edge.

3. An expanded metal machine according to claim 1; wherein the longitudinally and convexly curved leading central portion of each tooth has a radius of curvature between one and two times the length of said leading central portion.

4. An expanded metal machine according to claim 1; wherein the straight end portions of each tooth are inclined backwardly at an angle of at least 35° with respect to the axial length of the knife.

* * * * *